US009934880B2

(12) United States Patent
Labranche

(10) Patent No.: US 9,934,880 B2
(45) Date of Patent: Apr. 3, 2018

(54) COPPER PASTE COMPOSITION AND ITS USE IN A METHOD FOR FORMING COPPER CONDUCTORS ON SUBSTRATES

(71) Applicant: E I DU PONT DE NEMOURS AND COMPANY, Wilmington, DE (US)

(72) Inventor: Marc Henry Labranche, Chapel Hill, NC (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 113 days.

(21) Appl. No.: 14/960,814

(22) Filed: Dec. 7, 2015

(65) Prior Publication Data

US 2016/0086682 A1 Mar. 24, 2016

Related U.S. Application Data

(62) Division of application No. 13/758,567, filed on Feb. 4, 2013, now Pat. No. 9,236,155.

(51) Int. Cl.

| | |
|---|---|
| ***H01B 1/16*** | (2006.01) |
| ***B05D 5/12*** | (2006.01) |
| ***H01B 1/02*** | (2006.01) |
| ***H01B 1/22*** | (2006.01) |
| ***H01B 13/00*** | (2006.01) |

(52) U.S. Cl.

CPC ..... *H01B 1/02* (2013.01); *B05D 5/12* (2013.01); *H01B 1/16* (2013.01); *H01B 1/22* (2013.01); *H01B 13/0016* (2013.01)

(58) Field of Classification Search

CPC ... H01B 1/00; H01B 1/16; B05D 5/12; C09D 5/24; C03C 12/00; C03C 14/006; C03C 2214/00

See application file for complete search history.

(56) References Cited

U.S. PATENT DOCUMENTS

| | | | | |
|---|---|---|---|---|
| 5,089,172 | A | 2/1992 | Allison et al. | |
| 5,165,986 | A | 11/1992 | Gardner et al. | |
| 5,336,444 | A | 8/1994 | Casey et al. | |
| 5,376,596 | A * | 12/1994 | Tokuda | C03C 8/04 106/1.12 |
| 5,393,558 | A | 2/1995 | Allison et al. | |
| 5,645,765 | A | 7/1997 | Asada et al. | |
| 6,103,146 | A | 8/2000 | Okamoto | |
| 6,207,288 | B1 | 3/2001 | Bloom | |
| 6,444,297 | B1 | 9/2002 | Bischel | |
| 6,841,495 | B2 | 1/2005 | Tanaka et al. | |
| 2005/0277550 | A1 | 12/2005 | Brown et al. | |
| 2006/0231803 | A1 * | 10/2006 | Wang | C03C 3/064 252/500 |

(Continued)

FOREIGN PATENT DOCUMENTS

| | | | |
|---|---|---|---|
| EP | 0711255 | B1 | 10/1997 |
| EP | 2444979 | A1 | 4/2012 |
| WO | 95/04005 | A1 | 2/1995 |

*Primary Examiner* — Mark Kopec

(57) ABSTRACT

This invention relates to a copper thick film paste composition paste comprising copper powder, a Pb-free, Bi-free and Cd-free borosilicate glass frit, ruthenium-based powder, and an organic vehicle. The invention also provides methods of using the copper thick film paste composition to make a copper conductor on a substrate. Typical substrates are selected from the group consisting of aluminum nitride, aluminum oxide and silicon nitride.

8 Claims, 1 Drawing Sheet

(56) References Cited

U.S. PATENT DOCUMENTS

| | | | | |
|---|---|---|---|---|
| 2012/0119165 | A1 | 5/2012 | Wang et al. | |
| 2013/0043441 | A1* | 2/2013 | Ozawa | H01B 1/22 252/513 |

* cited by examiner

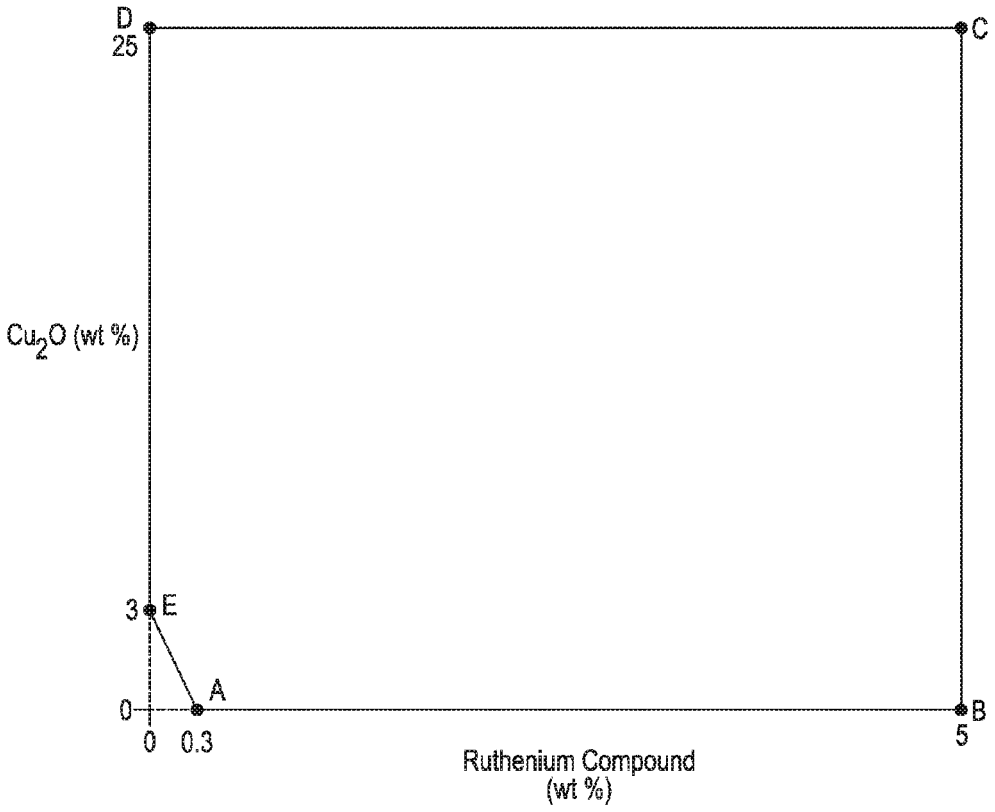
D
25
C
$Cu_2O$ (wt %)
3
E
A
0
B
0
0.3
5
Ruthenium Compound
(wt %)

COPPER PASTE COMPOSITION AND ITS USE IN A METHOD FOR FORMING COPPER CONDUCTORS ON SUBSTRATES

This application is a divisional of Ser. No. 13/758,567, filed on Feb. 4, 2013, now U.S. Pat. No. 9,236,155 which is herein incorporated by reference.

FIELD OF THE INVENTION

This invention is directed to a copper paste and its use in a method for forming copper conductors on various substrates and, in particular, on substrates of aluminum nitride, aluminum oxide and silicon nitride.

TECHNICAL BACKGROUND OF THE INVENTION

Generally, thick film conductor paste compositions contain a conductive component, a binder, and an organic medium as the principal components. As the conductive component, fine powders of the noble metals palladium (Pd), platinum (Pt), gold (Au) and silver (Ag), or mixtures or alloys thereof, or oxides of palladium and silver, or mixtures thereof, have been widely used. Glass powder and various oxides are commonly used for the binder for these conductors, and the organic medium is an inert solution of polymers in an organic solvent or solvent mixture. The organic medium determines the application characteristics of the composition.

Fine powders of copper have also been used as the conductive component. Copper conductors can have very good electrical properties, good thermal conductivity and good solderability, and have a lower material cost compared to the noble metal conductors. Conductors based on copper need to be fired in an inert gas atmosphere to avoid oxidation, while conductors based on noble metals can simply be fired in air.

These thick film conductor pastes are typically applied to ceramic substrates by screen printing. Other methods of applying paste to a substrate such as spraying or brushing can also be used. The organic medium is adjusted to provide the proper viscosity and drying rate for the intended application. The conductive component and the inorganic binder, however, can be the same for all of these methods of application.

The screen printing process consists of forcing the thick film composition through a stencil screen onto the substrate with a squeegee. The open pattern in the stencil screen defines the pattern that will be printed onto the substrate. Solvents are removed by drying, and the dried prints are then fired to remove the residual resin and to densify the conductor. Ceramic substrates such as aluminum oxide or aluminum nitride are commonly used.

Improved copper conductor compositions are needed to provide a copper conductor with low resistivity and the necessary adhesion to the substrate.

SUMMARY OF THE INVENTION

The present invention provides a copper thick film paste composition comprising:

a) 30-95 wt % copper powder;

b) 0.5-10 wt % Pb-free, Bi-free and Cd-free borosilicate glass frit;

c) a component selected from the group consisting of ruthenium-based powder, copper oxide powder and mixtures thereof, wherein the amounts in wt % of ruthenium-based powder and copper oxide contained in the copper thick film paste composition, expressed in terms of an equivalent amount of $CuO_2$, fall within the area defined by points A-E in the FIGURE, wherein the ruthenium-based powder is selected from the group of powders consisting of Ru, $RuO_2$, $CaRuO_3$, $SrRuO_3$, $BaRuO_3$, $Li_2RuO_3$, ion-exchanged $Li_2RuO_3$ wherein Li atoms have been at least partially exchanged for Al, Ga, K, Ca, Mn, Fe, Mg, H, Na, Cr, Co, Ni, V, Cu, Zn, Ti or Zr atoms, compounds corresponding to the formula $(M_x Bi_{2-x})(M'_y M''_{2-y})O_{7-z}$ wherein M is selected from the group consisting of yttrium, thallium, indium, cadmium, lead, copper and the rare earth metals, M' is selected from the group consisting of platinum, titanium, chromium, rhodium and antimony, M" is selected from the group consisting ruthenium and a mixture of ruthenium and iridium, x is 0-2 with the proviso that when M is monovalent copper, x=1; y is 0-0.5 with the proviso that y is 0-1 when M' is either rhodium or more than one of platinum, titanium, chromium, rhodium and antimony; and z is 0-1 with the proviso that it is at least equal to approximately x/2 when M is divalent lead or cadmium, and mixtures and precursors thereof, wherein the copper oxide powder is selected from the group consisting of $Cu_2O$ and CuO and mixtures thereof, and wherein the wt % are based on the total weight of the composition; and d) an organic medium comprising solvent and resin;

wherein the copper powder, the Pb-free, Bi-free and Cd-free borosilicate glass frit, and the component selected from the group consisting of ruthenium-based powder, copper oxide powder and mixtures thereof are dispersed in the organic medium.

The invention also provides method of making a copper conductor on a substrate comprising the steps of:

a) providing a substrate;

b) providing a copper thick film paste composition comprising:

i) 30-95 wt % copper powder;

ii) 0.5-10 wt % Pb-free, Bi-free and Cd-free borosilicate glass frit;

iii) a component selected from the group consisting of ruthenium-based powder, copper oxide powder and mixtures thereof, wherein the amounts in wt % of ruthenium-based powder and copper oxide contained in the copper thick film paste composition, expressed in terms of an equivalent amount of $CuO_2$, fall within the area defined by points A-E in FIG. 1, wherein the ruthenium-based powder is selected from the group of powders consisting of Ru, $RuO_2$, $CaRuO_3$, $SrRuO_3$, $BaRuO_3$, $Li_2RuO_3$, ion-exchanged $Li_2RuO_3$ wherein Li atoms have been at least partially exchanged for Al, Ga, K, Ca, Mn, Fe, Mg, H, Na, Cr, Co, Ni, V, Cu, Zn, Ti or Zr atoms, compounds corresponding to the formula $(M_x Bi_{2-x})(M'_y M''_{2-y})O_{7-z}$ wherein M is selected from the group consisting of yttrium, thallium, indium, cadmium, lead, copper and the rare earth metals, M' is selected from the group consisting of platinum, titanium, chromium, rhodium and antimony, M" is selected from the group consisting ruthenium and a mixture of ruthenium and iridium, x is 0-2 with the proviso that when M is monovalent copper, x=1; y is 0-0.5 with the proviso that y is 0-1 when M' is either rhodium or more than one of platinum, titanium, chromium, rhodium and antimony; and z is 0-1 with the proviso that it is at least equal to approximately x/2 when M is divalent lead or cadmium, and mixtures and precursors thereof, and wherein the copper oxide powder is selected from the group consisting of $Cu_2O$ and CuO and mixtures thereof, and wherein the wt % are based on the total weight of the composition; and iv) an organic medium comprising solvent and resin;

wherein the copper powder, the Pb-free, Bi-free and Cd-free borosilicate glass frit, and the component selected from the group consisting of ruthenium-based powder, copper oxide powder and mixtures thereof are dispersed in the organic medium.

c) applying a layer of the copper thick film paste to the substrate;

d) drying the layer of copper thick film paste composition to volatilize the solvent and form a dried layer of copper thick film paste composition; and e) firing the dried layer of copper thick film paste composition to volatilize the resin and densify the dried layer of copper thick film paste composition, thereby forming the copper conductor.

In one embodiment the method further comprises:

f) applying a layer of thick film paste overprint composition to the copper conductor formed in step e), the thick film paste overprint composition comprising 30-95 wt % copper powder dispersed in an organic medium comprising solvent and resin;

g) drying the layer of thick film paste overprint to volatilize the solvent and form a dried layer of thick film paste overprint; and h) firing the dried layer of thick film paste overprint to volatilize the resin and densify the dried layer of thick film paste overprint.

The invention also provides a method of making a copper conductor composition with a copper overprint on a substrate comprising the steps of a) providing a substrate;

b) providing a copper thick film paste comprising:

i) 30-95 wt % copper powder;

ii) 0.5-10 wt % Pb-free, Bi-free and Cd-free borosilicate glass frit;

iii) a component selected from the group consisting of ruthenium-based powder, copper oxide powder and mixtures thereof, wherein the amounts in wt % of ruthenium-based powder and copper oxide contained in the copper thick film paste composition, expressed in terms of an equivalent amount of $CuO_2$, fall within the area defined by points A-E in the FIGURE, wherein the ruthenium-based powder is selected from the group of powders consisting of Ru, $RuO_2$, $CaRuO_3$, $SrRuO_3$, $BaRuO_3$, $Li_2RuO_3$, ion-exchanged $Li_2RuO_3$ wherein Li atoms have been at least partially exchanged for Al, Ga, K, Ca, Mn, Fe, Mg, H, Na, Cr, Co, Ni, V, Cu, Zn, Ti or Zr atoms, compounds corresponding to the formula $(M_x Bi_{2-x})(M'_y M''_{2-y})O_{7-z}$ wherein M is selected from the group consisting of yttrium, thallium, indium, cadmium, lead, copper and the rare earth metals, M' is selected from the group consisting of platinum, titanium, chromium, rhodium and antimony, M" is selected from the group consisting ruthenium and a mixture of ruthenium and iridium, x is 0-2 with the proviso that when M is monovalent copper, x=1; y is 0-0.5 with the proviso that y is 0-1 when M' is either rhodium or more than one of platinum, titanium, chromium, rhodium and antimony; and z is 0-1 with the proviso that it is at least equal to approximately x/2 when M is divalent lead or cadmium, and mixtures and precursors thereof, and wherein the copper oxide powder is selected from the group consisting of $Cu_2O$ and CuO and mixtures thereof, and wherein the wt % are based on the total weight of the composition; and iv) an organic medium comprising solvent and resin;

wherein the copper powder, the Pb-free, Bi-free and Cd-free borosilicate glass frit, and the component selected from the group consisting of ruthenium-based powder, copper oxide powder and mixtures thereof are dispersed in the organic medium;

c) applying a layer of the copper thick film paste to the substrate;

d) drying the layer of copper thick film paste composition to volatilize the solvent and form a dried layer of copper thick film paste composition;

e) applying a thick film paste overprint composition to the dried layer of copper thick film paste composition formed in step e), the thick film paste overprint composition comprising 30-95 wt % copper powder dispersed in an organic medium comprising solvent and resin;

f) drying the layer of thick film paste overprint to volatilize the solvent and form a dried layer of thick film paste overprint; and g) firing the dried layer of copper thick film paste and the dried layer of thick film paste overprint to volatilize the resin in the layer of the copper thick film paste and the resin in the layer of thick film paste overprint and to densify the dried copper thick film paste and the dried thick film paste overprint, thereby forming the copper conductor with a copper overprint In some embodiments of the methods of making a copper conductor on a substrate, the substrate is selected from the group consisting of aluminum nitride, aluminum oxide and silicon nitride.

BRIEF DESCRIPTION OF THE FIGURE

The FIGURE shows the area defined by points A-E. The amounts in wt % of ruthenium-based powder and copper oxide, expressed in terms of an equivalent amount of $Cu_2O$, contained in the copper thick film composition fall within this area. The wt % are based on the total weight of the copper thick film composition.

DETAILED DESCRIPTION OF THE INVENTION

The copper thick film paste composition of the present invention allows for the production of copper conductors on aluminum nitride, aluminum oxide (alumina), silicon nitride and other substrates with improved performance. The copper thick film paste composition results in a copper conductor with good adhesion to the substrate. The copper conductor has sufficiently low resistivity. Since the there is no intentionally added lead (Pb) or cadmium (Cd), the product is free from the environmental concerns with these elements.

The comprises copper powder, a Pb-free, Bi-free, Cd-free borosilicate glass frit, a component selected from the group consisting of ruthenium-based powder, copper oxide powder and mixtures thereof and an organic vehicle.

The invention also provides methods of using the copper thick film paste composition to make a copper conductor on a substrate.

Each constituent of the copper thick film paste composition of the present invention is discussed in detail below.

Copper Powder

Copper powders suitable for screen printing are well-known in the art. Typically, a fired film thickness of 10-20 microns is achieved when printing with a 325 mesh screen, so a preferred powder has a maximum particle size less than 20 microns, and preferably less than 10 microns. The removal of organic resin from the thick film layer during firing is not as easy with nitrogen firing as it is with air firing of silver-based conductors, so a copper powder with average particle size less than about 1 micron may sinter too early in the firing cycle, resulting in blistering from entrapped organic residues. Therefore, a preferred copper powder has an average particle size from about 1 to 5 microns.

Copper powder also invariably has some residual oxide. Copper oxide is found to improve adhesion on AlN substrates, so when considering the copper oxide content of the paste, it is important to calculate the contribution from the native oxide of the copper powder. It is obvious to one skilled in the art that a more highly oxidized copper powder will carry more copper oxide into the composition than a less highly oxidized copper powder.

The copper powder is present in the copper thick film paste composition in a proportion of 30 to 95 wt %, based on the total weight of the copper thick film paste composition. In one embodiment, the copper is present in the copper thick film paste composition in a proportion of 55 to 90 wt %, based on the total weight of the copper thick film paste.

Pb-Free, Bi-Free and Cd-Free Borosilicate Glass Frit

Various Pb-free, Bi-free and Cd-free borosilicate glass frits are useful in forming the instant copper thick film paste composition. In one embodiment, the copper thick film paste composition contains 0.5-10 wt % of Pb-free, Bi-free and Cd-free borosilicate glass frit, wherein the wt % is based on the total weight of the copper thick film paste composition. In another embodiment, the copper thick film paste composition contains 1-5 wt % of Pb-free, Bi-free and Cd-free borosilicate glass frit, wherein the wt % is based on the total weight of the copper thick film paste composition.

Glass compositions are described herein as including mole percentages of certain components. Specifically, the mole percentages are the mole percentages of the components used in the starting material that was subsequently processed as described herein to form a glass composition. Such nomenclature is conventional to one of skill in the art. In other words, the composition contains certain components, and the mole percentages of those components are expressed as a mole percentage of the corresponding oxide form. The components of the glass composition may be supplied by various sources such as oxides, halides, carbonates, nitrates, phosphates, hydroxides, peroxides, halogen compounds and mixtures thereof. Herein, the composition of the Pb-free, Bi-free and Cd-free borosilicate glass frit is given in terms of the equivalent oxides no matter the source of the various components. As recognized by one of ordinary skill in the art in glass chemistry, a certain portion of volatile species may be released during the process of making the glass. An example of a volatile species is oxygen.

The oxide product of the process described herein is typically essentially an amorphous (non-crystalline) solid material, i.e., a glass. However, in some embodiments the resulting oxide may be amorphous, partially amorphous, partially crystalline or combinations thereof. As used herein "glass frit" includes all such products.

If starting with a fired glass, one of ordinary skill in the art may calculate the mole percentages of starting components described herein using methods known to one of skill in the art including, but not limited to: Inductively Coupled Plasma-Mass Spectroscopy (ICP-MS), Inductively Coupled Plasma-Atomic Emission Spectroscopy (ICP-AES), and the like. In addition, the following exemplary techniques may be used: X-Ray Fluorescence spectroscopy (XRF); Nuclear Magnetic Resonance spectroscopy (NMR); Electron Paramagnetic Resonance spectroscopy (EPR); Mössbauer spectroscopy; electron microprobe Energy Dispersive Spectroscopy (EDS); electron microprobe Wavelength Dispersive Spectroscopy (WDS); or Cathodo-Luminescence (CL).

The various glass frits may be prepared by mixing the oxides to be incorporated therein (or other materials that decompose into the desired oxides when heated) using techniques understood by one of ordinary skill in the art. Such preparation techniques may involve heating the mixture in air or an oxygen-containing atmosphere to form a melt, quenching the melt, and grinding, milling, and/or screening the quenched material to provide a powder with the desired particle size. Melting the mixture of oxides to be incorporated therein is typically conducted to a peak temperature of 1000 to 1400° C. The molten mixture can be quenched, for example, on a stainless steel platen or between counter-rotating stainless steel rollers to form a platelet. The resulting platelet can be milled to form a powder. Typically, the milled powder has a $d_{50}$ of 0.1 to 5 microns, and preferable 1 to 3 microns. One skilled in the art of producing glass frit may employ alternative synthesis techniques such as but not limited to water quenching, sol-gel, spray pyrolysis, or others appropriate for making powder forms of glass.

One of ordinary skill in the art would recognize that the choice of raw materials could unintentionally include impurities that may be incorporated into the glass during processing. For example, the impurities may be present in the range of hundreds to thousands ppm. The presence of the impurities would not alter the properties of the glass, the composition, e.g. a thick-film composition, or the fired device. For example, a copper thick film composition fired onto an aluminum nitride substrate may have the efficiency described herein even if the thick-film composition includes impurities. "Lead-free," "cadmium-free" and "bismuth-free" as used herein mean that no lead, cadmium or bismuth has been intentionally added.

The Pb-free, Bi-free and Cd-free borosilicate glass frits useful in the copper thick film paste composition are of the alkali alumino-borosilicate, alkaline-earth zinc-alumino-borosilicate, and the alkali/alkaline-earth zinc alumino-borosilicate families.

In one embodiment the Pb-free, Bi-free and Cd-free borosilicate glass is an alkali alumino-borosilicate glass comprising 2-10 mole % ($Na_2O+K_2O+Li_2O$), 0.5-5 mole % $Al_2O_3$, 10-30 mole % $B_2O_3$, and 40-85 mole % $SiO_2$. In a further embodiment, in addition to the above components, the starting mixture used to make the alkali alumino-borosilicate glass may include small amounts of one or more other components.

In another embodiment the Pb-free, Bi-free and Cd-free borosilicate glass is an alkaline-earth zinc-alumino-borosilicate glass comprising 15-40 mole % ($BaO+ZnO+CaO+SrO$), 1-6 mole % $Al_2O_3$, 6-25 mole % $B_2O_3$, and 40-70 mole % $SiO_2$, wherein the ZnO content is 5-40 mole %. In a further embodiment, in addition to the above components, the starting mixture used to make the alkali alumino-borosilicate glass may include small amounts of one or more other components.

In still another embodiment the Pb-free, Bi-free and Cd-free borosilicate glass is an an alkali/alkaline earth zinc-alumino-borosilicate glass comprising 3-15 mole % (Na2O+K2O+Li2O), 10-50 mole % (BaO+ZnO+CaO+SrO), 10-35 mole % B2O3, 0.1-8 mole % Al2O3, and 10-55 mole % SiO2, wherein the ZnO content is 5-40 mole %. In a further embodiment, in addition to the above components, the starting mixture used to make the alkali/alkaline earth zinc-alumino-borosilicate glass may include small amounts of one or more of $ZrO_2$, CuO, SrO, and $Ta_2O_5$ or other components.

Compositions of some of these glasses are shown in Table I

TABLE I

| Glass compositions (mole %) | | | | | |
|---|---|---|---|---|---|
| | A | B | C | D | E |
| $SiO_2$ | 25.90 | 27.46 | 25.64 | 53.70 | 83.27 |
| $Al_2O_3$ | 4.01 | 1.35 | 3.99 | 2.16 | 1.21 |
| $ZrO_2$ | 2.33 | | 2.32 | | |
| $B_2O_3$ | 27.50 | 27.64 | 27.36 | 12.96 | 11.53 |
| CaO | 5.12 | 10.42 | 4.96 | | |
| ZnO | 24.33 | 27.03 | 13.01 | 11.11 | |
| CuO | | | 2.82 | 5.56 | |
| BaO | 0.75 | | 10.45 | 3.70 | |
| $Na_2O$ | 10.07 | 6.10 | 9.31 | 6.17 | 3.99 |
| $K_2O$ | | | | 1.23 | |
| SrO | | | | 2.47 | |
| $Ta_2O_5$ | | | 0.14 | 0.93 | |

Conventional bismuth-based glass frits have not resulted in copper conductors with adequate adhesion to the substrate. Some compositions, glasses F-H of such bismuth-based glass frits are shown in Table II These frits are used in Comparative Experiments B-D. Also shown is an alkaline-earth alumino-borosilcate glass I that contains no ZnO and is used in a Comparative Experiment E.

TABLE II

| Glass compositions (mole %) | | | | |
|---|---|---|---|---|
| | F | G | H | I |
| $SiO_2$ | 17.45 | 20.88 | 4.73 | 37.00 |
| $Al_2O_3$ | | 3.69 | 0.23 | 5.00 |
| PbO | 14.77 | | | |
| $B_2O_3$ | 15.06 | 21.24 | 42.52 | 30.00 |
| CaO | | 1.67 | | |
| ZnO | | 26.09 | | |
| BaO | | | | 28.00 |
| $Na_2O$ | | | 1.91 | |
| $Bi_2O_3$ | 52.72 | 26.44 | 42.69 | |
| $Li_2O$ | | | 7.93 | |

Ruthenium-Based Powder and Copper Oxide Powder

The ruthenium-based powder is selected from the group of powders consisting of Ru, $RuO_2$, $CaRuO_3$, $SrRuO_3$, $BaRuO_3$, $Li_2RuO_3$, ion-exchanged $Li_2RuO_3$ wherein Li atoms have been at least partially exchanged for Al, Ga, K, Ca, Mn, Fe, Mg, H, Na, Cr, Co, Ni, V, Cu, Zn, Ti or Zr atoms, compounds corresponding to the formula $(M_x\ Bi_{2-x})\ (M'_y\ M''_{2-y})O_{7-z}$ wherein M is selected from the group consisting of yttrium, thallium, indium, cadmium, lead, copper and the rare earth metals, M' is selected from the group consisting of platinum, titanium, chromium, rhodium and antimony, M'' is selected from the group consisting ruthenium and a mixture of ruthenium and iridium, x is 0-2 with the proviso that when M is monovalent copper, x=1; y is 0-0.5 with the proviso that y is 0-1 when M' is either rhodium or more than one of platinum, titanium, chromium, rhodium and antimony; and z is 0-1 with the proviso that it is at least equal to approximately x/2 when M is divalent lead or cadmium, and mixtures and precursors thereof. In one embodiment the ruthenium-based powder is $RuO_2$ powder. The surface area of the $RuO_2$ can be from about 5 to 100 $m^2/g$. In one embodiment the range is from about 10 to 50 $m^2/g$.

The average particle size of the particles in the ruthenium-based powder should be below 10 microns. In one embodiment the average particle size of the particles is below 1 micron. A ruthenium-based powder with excessively large particle sizes would not produce the same adhesion benefit as a smaller particle size powder.

Copper has two oxides—$Cu_2O$ and CuO. A powder of either can be added to the copper thick film paste composition of the invention. In addition, as described above, the copper powder can have a native oxide associated with it, typically $Cu_2O$, though not limited to that.

It's convenient to calculate the total copper oxide content of the copper thick film paste composition by adding together the oxygen present with the copper powder as well as the amount of $Cu_2O$ and CuO added to the copper thick film paste composition. The oxygen content of the copper powder is usually reported as weight % oxygen associated with the powder, while the $Cu_2O$ and CuO are added as weight % in the paste. The oxygen contribution from $Cu_2O$ is lower than CuO per gram of each owing to the stoichiometry of the two. Herein and in FIG. 1, all of the oxygen from the copper powder and from the added $Cu_2O$ or CuO is expressed as an equivalent amount of $Cu_2O$ in the copper thick film paste composition and this equivalent amount of $Cu_2O$ will be referred to as the amount of copper oxide in the copper thick film paste composition. The atomic and molecular weights used for oxygen, copper, $Cu_2O$ and CuO are 16, 63.54, 143.08 and 79.54, respectively. The equation for the equivalent amount of $Cu_2O$ in the copper thick film paste composition is:

Equivalent amount of $Cu_2O$ in the paste=(oxygen % of the copper powder)×(Cu powder % in the paste)×(143.08/16)+($Cu_2O$ % in the paste)+(CuO % in the paste)×(143.08/79.54)

The amounts of ruthenium-based powder and the equivalent amount of $Cu_2O$ powder, in wt % based on the total weight of the copper thick film paste composition, contained by the copper thick film paste composition of the invention fall within the area defined by points A-E, i.e., points A, B, C, D and E, in the FIGURE. As indicated in FIGURE, point A indicates 0.3 wt % ruthenium compound and 0 wt % $Cu_2O$, point B indicates 5 wt % ruthenium compound and 0 wt % $Cu_2O$, point D indicates 0 wt % ruthenium compound and 25 wt % $Cu_2O$ and point E indicates 0 wt % ruthenium compound and 3 wt % $Cu_2O$. Point C corresponds to 5 wt % ruthenium compound and 25 wt % $Cu_2O$. For the purposes herein "fall within the area defined by points A-E, i.e., points A, B, C, D and E, in the FIGURE" includes the perimeter of the area. Therefore lines AB, BC, CD DE and EA are included as falling within the area defined by points A-E.

An amount of 20 wt % added copper oxide is approaching an upper limit with regard to soldering by the means used herein. Higher copper oxide levels could be employed if additional means are used to improve the solderability such as a stronger solder flux, a thicker fired overprint, burnished pads, or a plating layer applied to the overprint.

Organic Medium

The copper thick film paste composition comprises an organic medium. The organic medium is a solution of organic polymer in organic solvent. Organic mediums used for screen printing are well-known in the art.

Any inert liquid may be used as the solvent in the organic medium so long as it volatilizes out cleanly upon drying and firing. Various organic liquids, with or without thickening and/or stabilizing agents and/or other additives, may be used in the organic medium. Exemplary of organic liquids which can be used are the aliphatic alcohols, esters of such alcohols, for example, acetates and propionates, terpenes such as terpineol, solutions of resins such as the polymethacrylates of lower alcohols, and solutions of ethyl cellulose in solvents such as Texanol, and the monobutyl ether of ethylene glycol monoacetate. The organic medium may also contain volatile liquids to promote fast drying after application to the substrate.

The copper thick film paste composition requires firing in an inert atmosphere such as nitrogen. It has been found that, unlike with conventional air-firable thick film compositions, it is better if the organic polymer content of the organic medium used in the copper thick film paste composition is kept to a minimum. For example, ethyl cellulose resin should be maintained at no higher than 1.0% by weight of the solids content of the dispersion. In one embodiment the polymer level is no higher than 0.7 wt %. However, higher polymer levels of 1-20 wt % must be used with acrylic resins in order to achieve a satisfactory printing viscosity. Fortunately these higher polymer levels can be tolerated because acrylics exhibit superior burnout characteristics when fired in nitrogen. Somewhat higher polymer levels in the organic medium can be tolerated if the nitrogen firing atmosphere contains several ppm oxygen in the burnout zone of the furnace.

The organic medium must contain at least about 0.5 to 3% by weight resin in order to obtain suitable rheological properties in the dispersion and adequate green strength in the applied copper film when it is applied by screen printing.

The inorganic solid particles are mixed with an organic liquid medium by mechanical mixing to form a pastelike composition having suitable consistency and rheology for screen printing. The paste is then printed as a "thick film" on a substrate in the conventional manner.

The solids are dispersed in the organic medium and the ratio of organic medium to solids in the dispersion can vary considerably and depends upon the manner in which the dispersion is to be applied, the kind of medium used, and the desired fired thickness. Normally, to achieve good coverage, and to minimize the resin loading, the dispersion will contain 60-95 wt % solids and 5-40 wt % organic medium. In one embodiment, the dispersion will contain 80-95 wt % solids and 5-20 wt % organic medium.

Formulation And Application

The copper thick film paste composition is prepared by dispersing the desired amounts of the copper powder, the Pb-free, Bi-free, Cd-free borosilicate glass frit, and the component selected from the group consisting of ruthenium-based powder, copper oxide powder and mixtures thereof in the desired amount of organic vehicle. The components are vigorously mixed to form a uniform blend. The blend is passed through dispersing equipment, such as a three roll mill, to achieve a good dispersion of particles. A Hegman gauge is used to determine the state of dispersion of the particles in the paste. This instrument consists of a channel in a block of steel that is 25 microns deep (1 mil) on one end and ramps up to zero depth at the other end. A blade is used to draw down paste along the length of the channel. Scratches will appear in the channel where the agglomerates' diameter is greater than the channel depth. A satisfactory dispersion will typically give a fourth scratch point of 10-18 microns. The point at which half of the channel is uncovered with a well dispersed paste is typically between 2 and 8 tmicrons. Fourth scratch measurement of >20 microns and "half-channel" measurements of >10 microns indicate a poorly dispersed suspension.

The batches of paste are then thinned as-needed with solvent to bring the viscosity to between 150 and 250 Pa·s at a shear rate of 4 $sec.^{-1}$.

A layer of the copper thick film paste composition is then applied to a substrate, usually by the process of screen printing. The copper thick film paste composition can be printed onto the substrate either by using an automatic printer or a hand printer in the conventional manner, using a 400 to 165 mesh screen. In one embodiment automatic screen stencil techniques are employed. The printed pattern layer of the copper thick film paste composition is then dried at about 120-150° C. for about 5-15 minutes to volatize the solvent before firing. Firing of the dried copper thick film paste composition layer is carried out in an essentially inert atmosphere such as a nitrogen atmosphere and results in a copper conductor. Firing to volatize the resin and densify the dried layer of copper thick film paste composition, i.e., to sinter the copper powder, the glass frit and any ruthenium-based powder or copper oxide powder present is preferably done in a nitrogen atmosphere belt conveyor furnace with a temperature profile that will allow burnout of the organic matter at about 300 to 600° C., a period of maximum temperature of about 750 to 950° C. lasting about 5-15 minutes, followed by a controlled cool-down cycle to prevent over-sintering, unwanted chemical reactions at intermediate temperatures or substrate fracture which can occur from too rapid cool-down. Total firing cycle times in the range of 30-60 minutes may be used. In one embodiment the maxim ium temperature of the firing is 830-880° C. The thickness of the fired pattern is in the range of 5-40 microns.

To ensure a highly solderable surface, an overprint can be applied to the fired copper conductor. The use of an overprint is well-known in the industry. An overprint can be fritless, or have a small amount of glass frit as long as the fired surface can be soldered acceptably.

An example of a suitable overprint is the DuPont QP165 (DuPont Co., Wilmington, Del.), a fritless overprint copper conductor. In the following Examples and Comparative Experiments, the overprint is printed onto the fired copper conductors, dried and fired before soldering.

Alternatively, the overprint can be applied to the dried layer of copper thick film paste composition. The overprint is then dried to volatize the solvent and form a dried layer of thick film paste overprint. Then the dried layer of copper thick film paste and the dried layer of thick film paste overprint are fired to volatilize the resin in the layer of the copper thick film paste and the resin in the layer of thick film paste overprint and to densify the dried copper thick film paste and the dried thick film paste overprint, thereby forming the copper conductor with a copper overprint. In one embodiment the firing is carried outv in a nitrogen atmosphere and at a temperature of 750 to 950° C.

Resistance Measurements

The resistivity of the fired copper conductor composition was measured before printing the overprint using a 200 square line of 0.020" width. Line resistance was measured with an LCR meter in a 4-wire configuration (Agilent Tech), and fired thickness was measured with a surface profilometer (KLA-Tencor, Model AS-500). A sheet resistivity was calculated per square of conductor track, normalized to 10 microns fired thickness using a 1/thickness dependence. The unit of milliohms/square at 10 microns fired thickness is the same as the unit of bulk resistivity reported as microohm-cm. Bulk Cu resistivity is quoted as 1.678 microohm-cm at 20° C., and it's preferable that the base layer be as close as possible to the bulk value. In practice, a resistivity of less than about 10 milliohm/sq/10 microns is preferred, with less than about 5 milliohm/sq/10 microns more preferable.

Adhesion Measurements

Adhesion of the fired copper conductor to the substrate was measured after applying the overprint and firing it. The overprint provides a more uniformly solderable surface than the patterned copper conductor. Adhesion was measured using an Instron Model 1122 pull tester in a 90° C. peel configuration at a pull rate of 2 inches per minute. Twenty gauge pre-tinned wires were attached to 80 mil×80 mil pads on the overprint by solder dipping for 10 seconds in 96.5Sn/3.0Ag/0.5Cu solder at 245° C., using Alpha 611 flux. Initial adhesion was measured after soldering and equilibrating overnight at room temperature. Aged adhesion was measured by aging the parts for 240 hours at 150° C. in a Blue M Stabil-Therm® oven. After aging, test parts \were allowed to equilibrate several hours in air before the wires are pulled. Twelve pads each were pulled for the initial adhesion and the aged adhesion test. A average peel force of at least 18 newtons, and preferably over 25 newtons, is considered to be essential for most applications.

EXAMPLES AND COMPARATIVE EXPERIMENTS

Comparative Experiment I

In Comparative Experiment I, 86 wt % copper powder (3.5 micron spherical powder from Fukuda) was mixed with 3 wt % frit A, an alkali/alkaline earth zinc-alumino-borosilicate glass from Table 1, and 11 wt % organic medium. The copper powder had an oxygen content of 0.15%. The organic medium was a mix of texanol solvent plus T200 Aqualon ethyl cellulose resin (Ashland, Inc). The paste was roll milled, and adjusted as needed to around 150-200 Pa·s viscosity at 10 rpm by thinning with additional texanol (Brookfield HAT, 14 spindle, 6R small sample adaptor for viscosity testing). The copper thick film paste composition so formed contained no ruthenium-based powder or copper oxide powder. The total copper oxide contained by the paste was that contained by the copper powder, 1.2 wt % expressed as $Cu_2O$. The copper thick film paste composition was printed onto 1"×1"×0.025" AlN substrates (Saint-Gobain 170 W/m-K). It was then dried at 130-150° C. for 10 minutes, and fired in a belt furnace in a nitrogen atmosphere at 850° C. peak temperature for 10 minutes. The door-to-door time through the belt furnace was approximately 1 hour. The fired thickness of the fired copper conductor layer was approximately 14 microns. The resistivity was measured as described above and was 2.7 milliohms/sq normalized to 10 microns fired thickness.

A QP-165 Cu overprint paste (DuPont Microcircuit Materials) was printed over the fired copper conductor using a 325 mesh stainless steel screen (Sefar), with 0.9 mil wire diameter and 0.3 mil emulsion. The overprint was dried and fired as described above. The overprint had a fired thickness of 10 microns.

Adhesion was measured as described above. The composition of Comparative Experiment I had an initial adhesion of 15 N, which is less than desired.

The composition and results are shown in Table III.

Examples 1-5

Examples 1-5 were carried out in the same manner as Comparative Experiment I except that $RuO_2$, $Cu_2O$ or both were added to the paste in amounts shown in Table III. The amount of copper powder was adjusted so that the sum of the copper powder, the glass frit, the added copper oxide, and the ruthenium compound was 89 wt % for each Example.

In Example 1, 1 wt % $RuO_2$ was added to the copper thick film paste composaition. The initial adhesion was 28 N. The resistivity increased to 4.1 milliohms/sq/10 microns.

In Example 2, 5 wt % $CuO_2$ was added to the copper thick film paste composition. The initial adhesion was to 23 N Example 1, and the resisitivity is 2.9 milliohms/sq/10 microns.

The synergistic benefit of increasing adhesion by combining the copper oxide and ruthenium compound is seen in Example 3, where both 5 wt % Cu2O and 1 wt % RuO2 were added. The Iinitial adhesion was 30 N, anaged adhesion of 25 N adhesion after 240 hours aging at 150° C., and the resistivity was 4.7 milliohms/sq/10 microns, which is still within the acceptable range.

Comparable adhesion can also be obtained with additions of larger amounts of copper oxide and no ruthenium compound. In Examples 4 and 5, 10 wt % and 20 wt % added $Cu_2O$, respectively, resulted in initial adhesions of 31 N and 29 N initial adhesion, 16 and 30 N adhesion after 240 hours aging at 150° C., and resistivities of 3.2 milliohms/sq/10 microns and 4.0 milliohms/sq/10 microns, respectively.

The compositions and results are shown in Table III.

TABLE III

Compositions and Results of Examples 1-5 and Comparative Experiment I

| | Comp Exp I | Ex. 1 | Ex. 2 | Ex. 3 | EX. 4 | Ex. 5 |
|---|---|---|---|---|---|---|
| Frit Type | A | A | A | A | A | A |
| Ru Compound | — | $RuO_2$ | — | $RuO_2$ | — | — |
| Cu Oxide Added | — | — | $Cu_2O$ | $Cu_2O$ | $Cu_2O$ | $Cu_2O$ |
| Cu Powder (wt %) | 86 | 85 | 81 | 80 | 76 | 66 |
| Frit (wt %) | 3 | 3 | 3 | 3 | 3 | 3 |
| Ru Compound (wt %) | — | 1 | — | 1 | — | — |
| Cu Oxide Added (wt %) | — | — | 5 | 5 | 10 | 20 |
| Total Cu Oxide expressed as Cu2O (wt %) | 1.2 | 1.1 | 6.1 | 6.1 | 11.0 | 20.9 |
| Texanol-ethyl cellulose organic (wt %) | 11 | 11 | 11 | 11 | 11 | 11 |
| Initial adhesion (N) | 15 | 28 | 23 | 30 | 31 | 29 |
| 240 h/150° C. aged adhesion (N) | 5 | 14 | 11 | 25 | 16 | 30 |
| Resistivity of base layer (milliohm/sq/10 microns) | 2.7 | 4.1 | 2.9 | 4.7 | 3.2 | 4.0 |

Examples 6-11

Examples 6-11 were carried out in the same manner as Comparative Experiment I except that both $RuO_2$ and $Cu_2O$ were added to the paste in amounts shown in Table IV.

Examples 6 and 7 contained 10 wt % and 20 wt % added $Cu_2O$, respectively, and 1 wt % $RuO_2$. Initial adhesion was 33 and 33 N, aged adhesion was 29 and 32 N, respectively. and resistivity 5.5 milliohms/sq/10 microns and 6.8 milliohms/sq/10 microns, respectively A practical upper limit on the amount of ruthenium compound is shown in Example 8, where 5 wt % $RuO_2$ was used, along with 5 wt % added $Cu_2O$. The initial adhesion was 26 N, and resistivity was 8.3 milliohms/sq/10 microns. There is a more significant resistivity penalty with $RuO_2$ than with $Cu_2O$ per unit weight of each, and obviously a cost penalty as well.

Different levels of glass frit A were used in Examples 9 and 10-1.5 wt % and 10 wt %, respectively. Initial adhesion of 29 N was achieved in Example 9 with 5 wt % added $Cu_2O$, and 0.6 wt % $RuO_2$, along with a resistivity of 4.0 milliohms/sq/10 microns. Initial adhesion of 26 N was achieved in Example 10 with 3 wt % added $Cu_2O$ and 3 wt % $RuO_2$, but with a degraded resistivity of 10.9 milliohms/sq/10 microns. A level of 10% frit is an upper limit because of the higher resistivity and also because degraded solderability is observed. It is apparent to someone skilled in the art that even higher frit levels could be employed if additional means are used to improve the solderability such as a stronger solder flux, a thicker fired overprint, burnished pads, or a plating layer applied to the overprint. High frit levels can also be expected to contribute to degraded thermal transfer to the substrate. An upper limit of 5 wt % frit is more desirable.

Even relatively low levels of ruthenium compound can have a beneficial contribution to adhesion. In Example 11, 0.3 wt % $RuO_2$ was used with 5 wt % added $Cu_2O$. Initial adhesion was 27 N, and resistivity was 3.6 milliohms/sq/10 microns.

The compositions and results are shown in Table IV.

TABLE IV

Compositions and Results of Examples 6-11

| | Ex. 6 | Ex. 7 | Ex. 8 | Ex. 9 | Ex. 10 | Ex. 11 |
|---|---|---|---|---|---|---|
| Frit Type | A | A | A | A | A | A |
| Ru Compound | $RuO_2$ | $RuO_2$ | $RuO_2$ | $RuO_2$ | $RuO_2$ | $RuO_2$ |
| Cu Oxide Added | $Cu_2O$ | $Cu_2O$ | $Cu_2O$ | $Cu_2O$ | $Cu_2O$ | $Cu_2O$ |
| Cu Powder (wt %) | 75 | 65 | 76 | 81.9 | 73 | 80.7 |
| Frit (wt %) | 3 | 3 | 3 | 1.5 | 10 | 3 |
| Ru Compound (wt %) | 1 | 1 | 5 | 0.6 | 3 | 0.3 |

TABLE IV-continued

Compositions and Results of Examples 6-11

| | Ex. 6 | Ex. 7 | Ex. 8 | Ex. 9 | Ex. 10 | Ex. 11 |
|---|---|---|---|---|---|---|
| Cu Oxide Added (wt %) | 10 | 20 | 5 | 5 | 3 | 5 |
| Total Cu Oxide expressed as Cu2O (wt %) | 11.0 | 20.9 | 6.0 | 6.1 | 4.0 | 6.1 |
| Texanol-ethyl cellulose organic (wt %) | 11 | 11 | 11 | 11 | 11 | 11 |
| Initial adhesion (N) | 33 | 33 | 26 | 29 | 26 | 27 |
| 240 h/150° C. aged adhesion (N) | 29 | 32 | 25 | 20 | 25 | 10 |
| Resistivity of base layer (milliohm/sq/10 microns) | 5.5 | 6.8 | 8.3 | 4.0 | 10.9 | 3.6 |

Examples 12-17

Examples 12-17 were carried out in the same manner as Comparative Experiment I with certain exceptions in each Example. As shown in Table V, the amount of copper powder was adjusted so that the sum of the copper powder, the glass frit, the added copper oxide, and the ruthenium compound was 89 wt % for each Example.

In Example 12, 0.3 wt % $RuO_2$ was added to the copper thick film paste composition with 3% glass frit A and zero added copper oxide. The initial adhesion was 21 N and the resistivity was 3.1 milliohms/sq/10 microns.

The addition of CuO instead of $Cu_2O$ is shown in Example 13. Here, 3 wt % CuO is added to the paste, along with 1 wt % $RuO_2$ and 3 wt % glass frit A. The effective copper oxide level in the paste, expressed as $Cu_2O$, is about 10.1 wt % as a result of the amount of oxygen associated with the copper powder as well as CuO having more oxygen per gram of powder than $Cu_2O$. Initial adhesion is 34 N.

The glass frits used in Examples 14, 15, and 16 were alkali/alkaline earth zinc-alumino-borosilicate glasses, frits B, C and D, respectively, all shown in Table I. The initial adhesions were 31 N, 31N and 28 N, respectively.

The glass frit used in Example 17 was an alkali alumino-borosilicate goass, frit H, shown in Table I. The initial adhesion was 25 N.

The composition and results are shown in Table V

TABLE V

Compositions and Results of Examples 12-17

| | Ex. 12 | Ex. 13 | Ex. 14 | Ex. 15 | Ex. 16 | Ex. 17 |
|---|---|---|---|---|---|---|
| Frit Type | A | A | B | C | D | E |
| Ru Compound | $RuO_2$ | $RuO_2$ | $RuO_2$ | $RuO_2$ | $RuO_2$— | $RuO_2$ |
| Cu Oxide Added | — | $Cu_2O$ | $Cu_2O$ | $Cu_2O$ | $Cu_2O$ | $Cu_2O$ |
| Cu Powder (wt %) | 85.7 | 80 | 80 | 80 | 80 | 80.7 |
| Frit (wt %) | 3 | 3 | 3 | 3 | 3 | 3 |
| Ru Compound (wt %) | 0.3 | 1 | 1 | 1 | 1 | 1 |
| Cu Oxide Added (wt %) | — | 5 | 5 | 5 | 5 | 5 |
| Total Cu Oxide expressed as Cu2O (wt %) | 1.1 | 10.1 | 6.1 | 6.1 | 6.1 | 6.1 |
| Texanol-ethyl cellulose organic (wt %) | 11 | 11 | 11 | 11 | 11 | 11 |
| Initial adhesion (N) | 21 | 34 | 31 | 31 | 28 | 25 |
| 240 h/150° C. aged adhesion (N) | 11 | 30 | 28 | 25 | 22 | 16 |
| Resistivity of base layer (milliohm/sq/10 microns) | 3.1 | 5.3 | 4.9 | 4.7 | 4.2 | 4.9 |

Examples 18-19

Examples 18 and 19 were carried out in the same manner as Comparative Experiment 1 except that other ruthenium compounds were used in place of $RuO_2$. Copper-bismuth ruthenate ($Cu_{0.5}Bi_{1.5}Ru_2O_{6.75}$) was used in Example 18 and lithium ruthenate ($Li_2RuO_3$) was used in Example 19. Initial adhesion was 34 N and 31 N, respectively and 240 hour aged adhesion was 22 N and 27 N, respectively The copper thick film paste composition used Example 19 was also printed onto an aluminum oxide (Coors $Al_2O_3$) substrate in a manner essentially as carried out for Example 19. The 240 hour aged adhesion was 26 N.

The compositions and results are shown in Table VI.

TABLE VI

Compositions and Results of Examples 18-19

| | | |
|---|---|---|
| Frit Type | A | A |
| Ru Compound | $Cu_{0.5}Bi_{1.5}RuO_{6.75}$ | $Li_2RuO_3$ |
| Cu Oxide Added | $Cu_2O$ | $Cu_2O$ |
| Cu Powder (wt %) | 80 | 79 |
| Frit (wt %) | 3 | 3 |
| Ru Compound (wt %) | 1 | 1 |
| Cu Oxide Added (wt %) | 5 | 6 |
| Total Cu Oxide expressed as Cu2O (wt %) | 6.1 | 7.1 |
| Texanol-ethyl cellulose organic (wt %) | 11 | 11 |
| Initial adhesion (N) | 34 | 31 |
| 240 h/150° C. aged adhesion (N) | 22 | 27 |
| Resistivity of base layer (milliohm/sq/10 microns) | 4.4 | 3.6 |

Comparative Experiments II-VI were carried out in the same manner as Comparative Experiment I with certain exceptions.

Bismuth-based glass frits F, G, and H of Table II, were used in Comparative Experiments II, III, and IV, respectively. The adhesion was poor or marginal with all three. Adhesion being listed as <5 means that the wires fell off while handling the parts, so that an accurate adhesion pull was not possible and it is believed that the actual adhesion value was less than 5 N.

An alkaline-earth alumino-borosilicate glass without zinc oxide, glass frit I of Table II, were used in Comparative Experiment V. The initial adhesion was only about 5 N.

In contrast to the use of a ruthenium compound to promote adhesion of the copper thick film paste composition to an AlN substrate, 1.5% lithium carbonate was used in Comparative Experiment VI. The printed copper layers blistered during firing, and adhesion was 14 N.

The compositions and results are shown in Table VII.

TABLE VII

Compositions and Resuts of Comparative Examples II-VI

| | Comp Exp II | Comp Exp III | Comp Exp IV | Comp Exp V | Comp Exp VI |
|---|---|---|---|---|---|
| Frit Type | F | G | H | I | A |
| Ru Compound | $RuO_2$ | $RuO_2$ | $RuO_2$ | $RuO_2$ | — |
| Cu Oxide Added | $Cu_2O$ | $Cu_2O$ | $Cu_2O$ | $Cu_2O$ | $Cu_2O$ |
| Cu Powder (wt %) | 80 | 80 | 80 | 80 | 83 |
| Frit (wt %) | 3 | 3 | 3 | 3 | 3 |
| Ru Compound (wt %) | 1 | 1 | 1 | 1 | — |
| Cu Oxide Added (wt %) | 5 | 5 | 5 | 5 | 3 |
| Total Cu Oxide expressed as Cu2O (wt %) | 6.1 | 6.1 | 6.1 | 6.1 | 4.1 |

TABLE VII-continued

Compositions and Resuts of Comparative Examples II-VI

| | Comp Exp II | Comp Exp III | Comp Exp IV | Comp Exp V | Comp Exp VI |
|---|---|---|---|---|---|
| Texanol-ethyl cellulose organic (wt %) | 11 | 11 | 11 | 11 | 11 |
| Lithium carbonate $Li_2CO_3$ (wt %) | — | — | — | — | 1.5 |
| Initial adhesion (N) | <5 | 16 | <5 | 5 | 14 |
| 240 h/150° C. aged adhesion (N) | — | 13 | — | — | — |
| Resistivity of base layer (milliohm/sq/10 microns) | 4.9 | 5.0 | 4.6 | 4.5 | — |

What is claimed is:

1. A copper thick film paste composition, comprising:

a) 30-95 wt % copper powder, wherein the copper powder has an oxygen content ≥0.15 wt %;

b) 0.5-10 wt % Pb-free, Bi-free and Cd-free alkali alumino-borosilicate glass powder consisting of 2-10 mole % ($Na_2O+K_2O+Li_2O$), 0.5-5 mole % $Al_2O_3$, 10-30 mole % $B_2O_3$, and 40-85 mole % $SiO_2$;

c) 0.3-5 wt % ruthenium-based powder, wherein the ruthenium-based powder is selected from the group of powders consisting of Ru, $RuO_2$, $CaRuO_3$, $SrRuO_3$, $BaRuO_3$, $Li_2RuO_3$, ion-exchanged $Li_2RuO_3$ wherein Li atoms have been at least partially exchanged for Al, Ga, K, Ca, Mn, Fe, Mg, H, Na, Cr, Co, Ni, V, Cu, Zn, Ti or Zr atoms, compounds corresponding to the formula $(M_x\ Bi_{2-x})\ (M'_y\ M''_{2-y})O_{7-z}$ wherein M is selected from the group consisting of yttrium, thallium, indium, cadmium, lead, copper and the rare earth metals, M' is selected from the group consisting of platinum, titanium, chromium, rhodium and antimony, M" is selected from the group consisting ruthenium and a mixture of ruthenium and iridium, x is 0-2 with the proviso that when M is monovalent copper, x=1; y is 0-0.5 with the proviso that y is 0-1 when M' is either rhodium or more than one of platinum, titanium, chromium, rhodium and antimony; and z is 0-1 with the proviso that it is at least equal to approximately x/2 when M is divalent lead or cadmium, and mixtures and precursors thereof, wherein the wt % are based on the total weight of the copper thick film paste composition; and d) an organic medium comprising solvent and resin;

wherein the copper powder, the alkali alumino-borosilicate glass powder, and the ruthenium-based powder are dispersed in the organic medium.

2. A copper thick film paste composition, comprising:

a) 30-95 wt % copper powder, wherein the copper powder has an oxygen content ≥0.15 wt %;

b) 0.5-10 wt % Pb-free, Bi-free and Cd-free alkaline-earth zinc-alumino-borosilicate glass powder consisting of 15-40 mole % (BaO+ZnO+CaO+SrO), 1-6 mole % $Al_2O_3$, 6-25 mole % $B_2O_3$, and 40-70 mole % $SiO_2$, wherein the ZnO content is 5-40 mole %;

c) 0.3-5 wt % ruthenium-based powder, wherein the ruthenium-based powder is selected from the group of powders consisting of Ru, $RuO_2$, $CaRuO_3$, $SrRuO_3$, $BaRuO_3$, $Li_2RuO_3$, ion-exchanged $Li_2RuO_3$ wherein Li atoms have been at least partially exchanged for Al, Ga, K, Ca, Mn, Fe, Mg, H, Na, Cr, Co, Ni, V, Cu, Zn, Ti or Zr atoms, compounds corresponding to the formula $(M_x\ Bi_{2-x})\ (M'_y\ M''_{2-y})O_{7-z}$ wherein M is selected from the group consisting of yttrium, thallium, indium, cadmium, lead, copper and the rare earth metals, M' is selected from the group consisting of platinum, titanium, chromium, rhodium and antimony, M" is selected from the group consisting ruthenium and a mixture of ruthenium and iridium, x is 0-2 with the proviso that when M is monovalent copper, x=1; y is 0-0.5 with the proviso that y is 0-1 when M' is either rhodium or more than one of platinum, titanium, chromium, rhodium and antimony; and z is 0-1 with the proviso that it is at least equal to approximately x/2 when M is divalent lead or cadmium, and mixtures and precursors thereof, wherein the wt % are based on the total weight of the copper thick film paste composition; and d) an organic medium comprising solvent and resin;

wherein the copper powder, the alkaline-earth zinc-alumino-borosilicate glass powder, and ruthenium-based powder are dispersed in the organic medium.

3. A copper thick film paste composition comprising:

a) 30-95 wt % copper powder, wherein the copper powder has an oxygen content ≥0.15 wt %;

b) 0.5-10 wt % Pb-free, Bi-free and Cd-free-alkali/alkaline-earth zinc-alumino-borosilicate glass powder consisting of 3-15 mole % ($Na_2O+K_2O+Li_2O$), 10-50 mole % (BaO+ZnO+CaO+SrO), 10-35 mole % B2O3, 0.1-8 mole % $Al_2O_3$, and 10-55 mole % $SiO_2$, wherein the ZnO content is 5-40 mole %;

c) 0.3-5 wt % ruthenium-based powder, wherein the ruthenium-based powder is selected from the group of powders consisting of Ru, $RuO_2$, $CaRuO_3$, $SrRuO_3$, $BaRuO_3$, $Li_2RuO_3$, ion-exchanged $Li_2RuO_3$ wherein Li atoms have been at least partially exchanged for Al, Ga, K, Ca, Mn, Fe, Mg, H, Na, Cr, Co, Ni, V, Cu, Zn, Ti or Zr atoms, compounds corresponding to the formula $(M_x Bi_{2-x})(M'_y M''_{2-y})O_{7-z}$ wherein M is selected from the group consisting of yttrium, thallium, indium, cadmium, lead, copper and the rare earth metals, M' is selected from the group consisting of platinum, titanium, chromium, rhodium and antimony, M" is selected from the group consisting ruthenium and a mixture of ruthenium and iridium, x is 0-2 with the proviso that when M is monovalent copper, x=1; y is 0-0.5 with the proviso that y is 0-1 when M' is either rhodium or more than one of platinum, titanium, chromium, rhodium and antimony; and z is 0-1 with the proviso that it is at least equal to approximately x/2 when M is divalent lead or cadmium, and mixtures and precursors thereof, wherein the wt % are based on the total weight of the copper thick film paste composition; and d) an organic medium comprising solvent and resin;

wherein the copper powder, alkali/alkaline-earth zinc-alumino-borosilicate glass powder, and ruthenium-based powder are dispersed in the organic medium.

4. A method of making a copper conductor on a substrate, comprising the steps of:

a) providing a substrate;

b) providing the copper thick film paste composition of any one of claims 1, 2 and 3;

c) applying a layer of the copper thick film paste composition to the substrate;

d) drying the layer of copper thick film paste composition to volatilize the solvent and form a dried layer of copper thick film paste composition; and e) firing the dried layer of copper thick film paste composition to volatilize the resin and densify the dried layer of copper thick film paste composition, thereby forming the copper conductor.

5. The method of claim 4, wherein the substrate is selected from the group consisting of aluminum nitride, aluminum oxide and silicon nitride.

6. The method of claim 4, further comprising:

f) applying a layer of thick film paste overprint composition to the copper conductor formed in step e), the thick film paste overprint composition comprising 30-95 wt % copper powder dispersed in an organic medium comprising solvent and resin;

g) drying the layer of thick film paste overprint to volatilize the solvent and form a dried layer of thick film paste overprint; and h) firing the dried layer of thick film paste overprint to volatilize the resin and densify the dried layer of thick film paste overprint.

7. A method of making a copper conductor on a substrate, comprising the steps of:

a) providing a substrate;

b) providing the copper thick film paste composition of any one of claims 1, 2 and 3:

c) applying a layer of the copper thick film paste to the substrate;

d) drying the layer of copper thick film paste composition to volatilize the solvent and form a dried layer of copper thick film paste composition;

e) applying a thick film paste overprint composition to the dried layer of copper thick film paste composition formed in step d), the thick film paste overprint composition comprising 30-95 wt % copper powder dispersed in an organic medium comprising solvent and resin;

f) drying the layer of thick film paste overprint to volatilize the solvent and form a dried layer of thick film paste overprint; and g) firing the dried layer of copper thick film paste and the dried layer of thick film paste overprint to volatilize the resin in the layer of the copper thick film paste and the resin in the layer of thick film paste overprint and to densify the dried copper thick film paste and the dried thick film paste overprint, thereby forming the copper conductor with a copper overprint.

8. The method of claim 7, wherein the substrate is selected from the group consisting of aluminum nitride, aluminum oxide and silicon nitride.

* * * * *